US006313816B1

(12) United States Patent
Kojima et al.

(10) Patent No.: US 6,313,816 B1
(45) Date of Patent: Nov. 6, 2001

(54) DISPLAY APPARATUS

(75) Inventors: Toshihisa Kojima, Saitama; Eizo Okamoto, Kanagawa; Hideaki Nakagawa, Tokyo, all of (JP)

(73) Assignee: Sony Corporation, Tokyo (JP)

( * ) Notice: Subject to any disclaimer, the term of this patent is extended or adjusted under 35 U.S.C. 154(b) by 0 days.

(21) Appl. No.: 09/396,292

(22) Filed: Sep. 15, 1999

(30) Foreign Application Priority Data

Sep. 16, 1998 (JP) ..... 10-261302

(51) Int. Cl.[7] ..... G09G 3/32
(52) U.S. Cl. ..... 345/83; 345/147
(58) Field of Search ..... 345/63, 72, 82, 345/83, 88, 89, 147, 150; 348/645, 671, 672, 674, 675; 358/518–523; 382/167, 168

(56) References Cited

U.S. PATENT DOCUMENTS 5,384,601 * 1/1995 Yamashita et al. ..... 345/647
5,446,504 * 8/1995 Wada ..... 345/645
5,764,216 * 6/1998 Tanaka et al. ..... 345/147
5,949,496 * 9/1999 Kim ..... 348/645

* cited by examiner

*Primary Examiner*—Regina Liang
(74) *Attorney, Agent, or Firm*—Jay H. Maioli

(57) ABSTRACT

Light emission data is supplied to an RDATA latch 13R, a GDATA latch 13G, and a BDATA latch 13B and latched as R, G, and B data for every pixel. In an arithmetic operation processing unit 14, an arithmetic operation is performed using the latched R, G, and B data and a chromaticity correction coefficient $C_{ij}$ written in a chromaticity correction coefficient register 16. An arithmetic operation result of the arithmetic operation processing unit 14 is supplied as correction light emission data into a data memory 15 and stored. In a luminance correction data memory 20, luminance correction data is supplied to a constant current driver 18 in accordance with a supplied control signal. The constant current driver 18 drives an LED display 19 in accordance with the correction light emission data and the luminance correction data.

9 Claims, 4 Drawing Sheets

DISPLAY APPARATUS

BACKGROUND OF THE INVENTION

1. Field of the Invention

The invention relates to a display apparatus such that, when forming a screen by arranging emitters like a mosaic display, if there is a portion of a different light emission wavelength that deteriorates uniformity of the screen, the color of the whole screen can be held uniform by performing a correction so that each of three primary colors of the color light emission has a same chromaticity point.

2. Description of the Related Art

For example, in the case where one pixel is constructed by a trio (hereinafter referred to as an RGB trio) of light emitting diodes (hereinafter referred to as LEDs) of three primary colors of R, G, and B and a mosaic display (large video display apparatus) is formed by arranging a number of pixels, it is necessary to select and use the LEDs such that the luminous intensity and light emission wavelength of the LED lie within a certain standard (hereinafter referred to as a rank). This is because it is necessary to avoid a problem of a color variation due to a variation in characteristics of the LEDs.

As such a variation, there are 1. variation in luminous and intensity (luminance)
2. variation in light emission wavelength (chromaticity)

In case of constructing one pixel by the RGB trio, the variation in luminous intensity deteriorates the uniformity of the luminance and the uniformity of the chromaticity of the halftone color. The variation in light emission wavelength deteriorates the uniformity of the chromaticity of the halftone color and three primary colors. If the LEDs having a variation in characteristics as mentioned above are used at random without selecting, a color variation due to a difference of the light emission wavelengths is conspicuous and the picture quality deteriorates.

However, in case of using the LEDs of the same rank for one screen, it is necessary to prepare the LEDs for maintenance every rank when considering the productivity of every screen and performing a service maintenance. There is, consequently, a problem of causing excessive costs for maintenance and the like as a whole.

In JP-A-10-26959, there has been disclosed a method such that both an amplitude and a DC level of a video signal of at least one of the R, G, and B colors are corrected by stored luminance correction data in accordance with a position of a screen in order to correct a luminance variation of each monochromatic color of R, G, and B due to the positions on an LED array which is caused by a variation in luminous intensity (luminance) of every element of an LED and a color variation due to the overlap of them. As mentioned above, the method such that the luminance variation due to the variation in luminous intensity (luminance) and the color variation due to the overlap of them are corrected by matching the luminance levels of the pixels of each monochromatic color has already been known.

According to the method disclosed in this literature, however, although the luminance variation due to the variation in luminous intensity (luminance) can be solved, there is a problem such that a color variation which is caused due to the variation in light emission wavelength (chromaticity) cannot be corrected.

OBJECTS AND SUMMARY OF THE INVENTION

It is, therefore, an object of the invention to provide a display apparatus which can keep expression colors (hereinafter, referred to as CIE tristimulus values) of each pixel constructing the whole screen uniform without selecting LEDs.

There is provided a display apparatus for displaying by a set of trios constructed by emitters of three primary colors on the basis of an input signal, wherein the apparatus has chromaticity correcting means for adding, to data of one color in the trio, data obtained by multiplying data of the other one or two colors in the trio by a pre-obtained chromaticity correction coefficient when each of the emitters of three primary colors is driven.

When a mosaic display in which one pixel is constructed from the emitters (RGB trio) of three primary colors and which is constructed by a set of a plurality of pixels is driven, the chromaticity correction coefficient which has previously been obtained and stored in a chromaticity correction data memory for light emission data that is supplied is corrected by the other one or two colors in accordance with a variation in characteristics of each emitter (LED). Thus, since the chromaticity points of the three primary colors can be matched, there is no need to perform a rank management of the light emission wavelengths of the emitters. The excessive costs for the improvement of the productivity of products, the service performance, the rank management of product stocks, and the like can be reduced and the products of the uniform image display quality can be stably manufactured.

The above and other objects and features of the present invention will become apparent from the following detailed description and the appended claims with reference to the accompanying drawings.

DETAILED DESCRIPTION OF THE PREFERRED EMBODIMENTS

Figure 1:
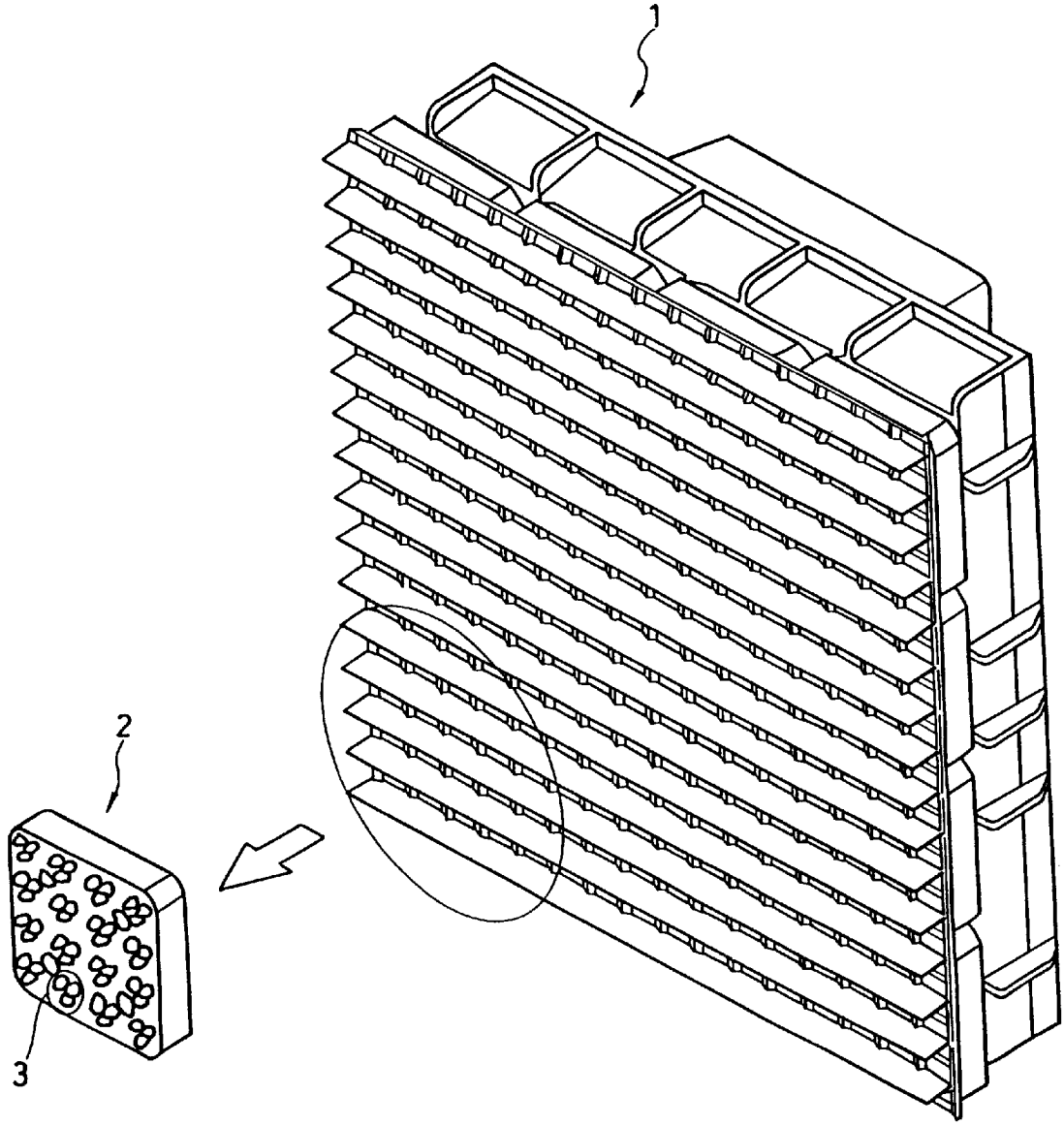
FIG. 1 is a perspective view of an example of a mosaic display to which the invention is applied.
Figure 2:
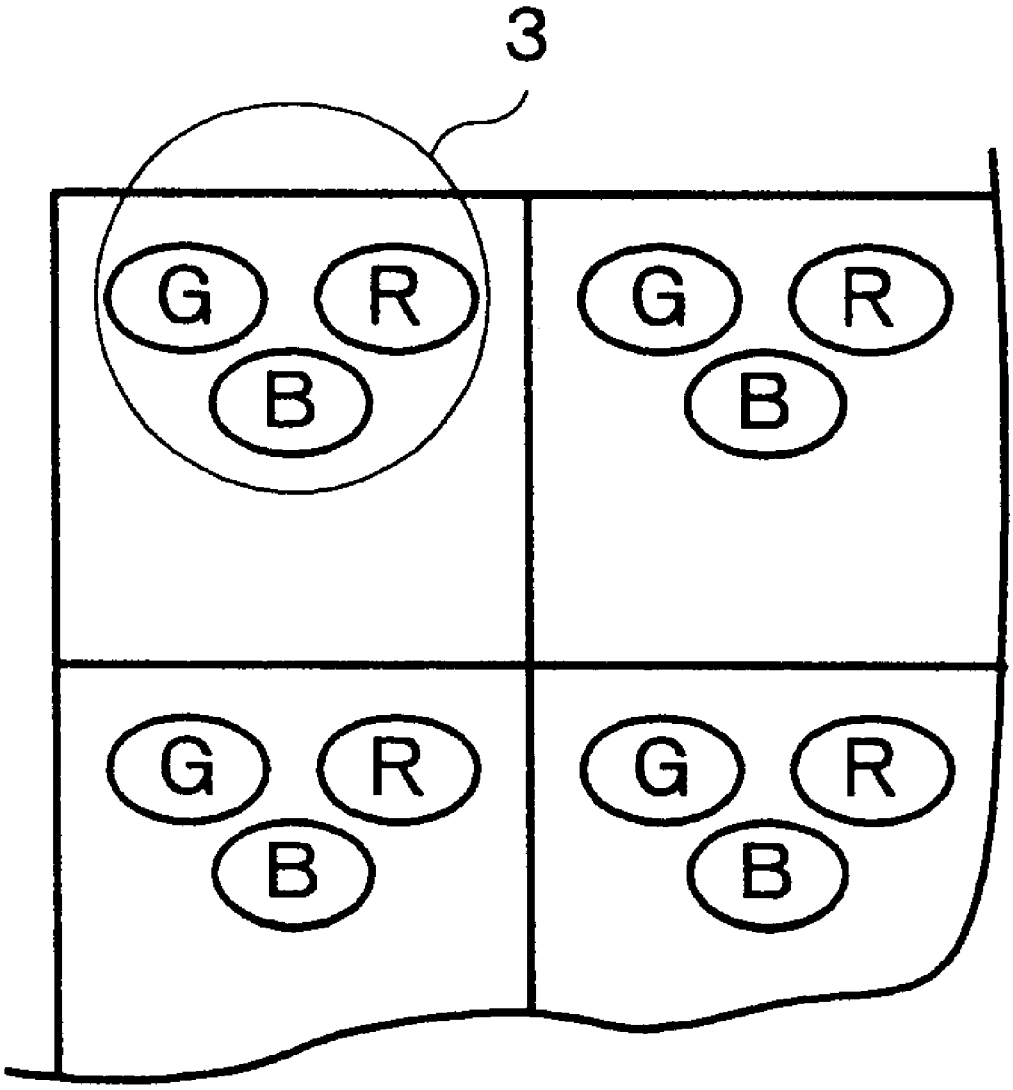
FIG. 2 is a schematic diagram for explaining pixels to which the invention is applied.

An embodiment of the invention will now be described hereinbelow with reference to the drawings. FIG. 1 is a perspective view of a mosaic display to which the embodiment is applied. In the example, units 2 (four units in the vertical direction and four units in the lateral direction) are arranged in a main body 1. Cells 3 (four cells in the vertical direction and four cells in the lateral direction) each constructed by emitters of three primary colors are arranged in the unit 2. As shown in FIG. 2, the cell 3 is made up of three LEDs of green (G), red (R), and blue (B) and one pixel is constructed by the three LEDs (hereinafter, referred to as an RGB trio). A further large mosaic display can be formed by arranging a plurality of main bodies 1 in the vertical and lateral directions.

Figure 3:
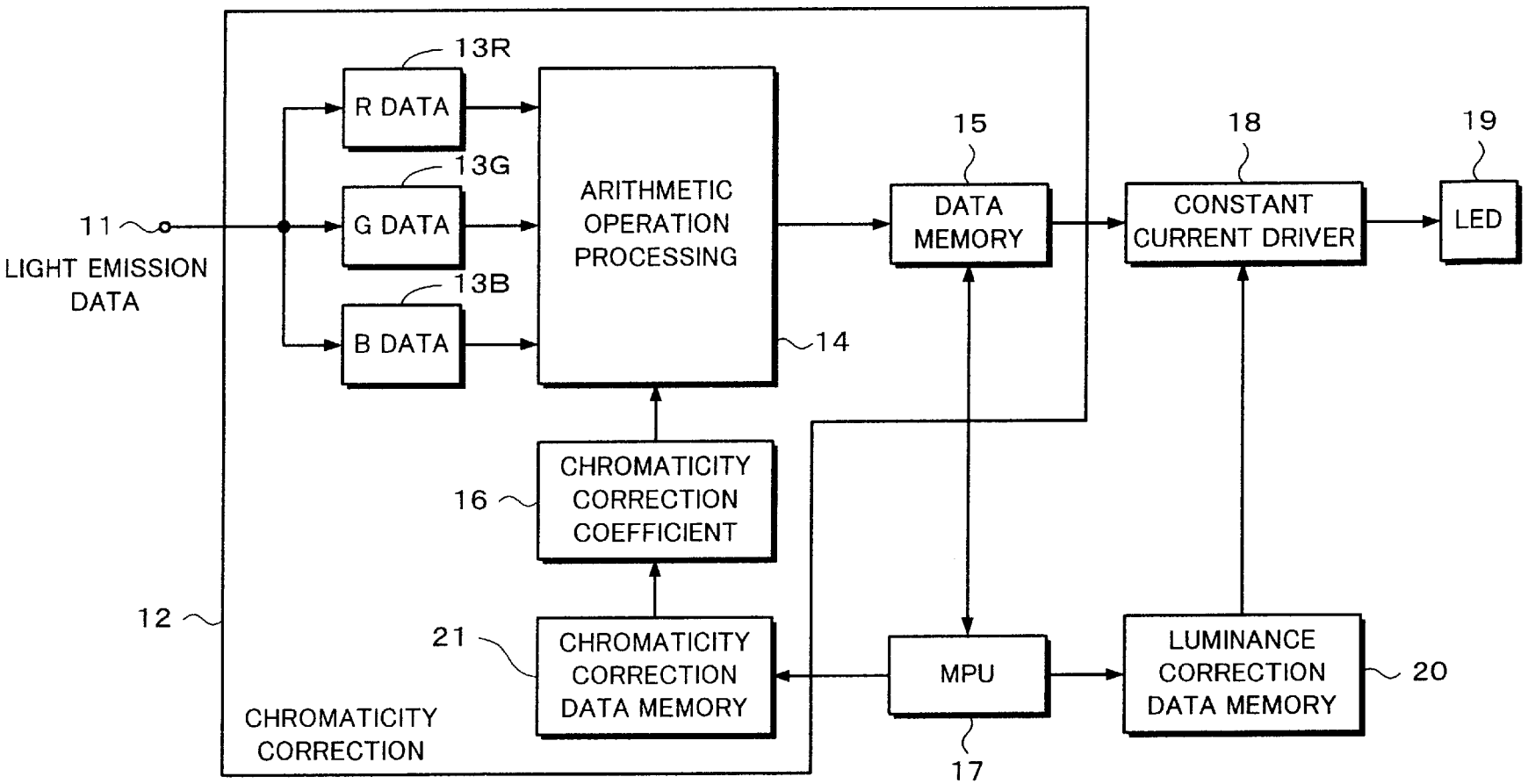
FIG. 3 is a block diagram of an embodiment of a light emitting unit to which the invention is applied.

The embodiment of the invention will now be described with reference to FIG. 3. Light emission data of an image is supplied from an image processing apparatus (not shown) to a chromaticity correcting unit 12 through an input terminal 11. The chromaticity correcting unit 12 comprises: a latch 13R for RDATA (data of a red component); a latch 13G for GDATA (data of a green component); a latch 13B for BDATA (data of a blue component); an arithmetic operation processing unit 14; a data memory 15; and a chromaticity correction coefficient register 16.

An MPU (microprocessor unit) 17 supplies a control signal to a chromaticity correction data memory 21 in which a chromaticity correction coefficient of each RGB trio has been stored. The chromaticity correction coefficients of the RGB trio according to the control signal are read out from the chromaticity correction data memory 21. The read-out chromaticity correction coefficients are written into the chromaticity correction coefficient register 16.

The chromaticity correction coefficients are coefficients such that characteristics of the RGB trio are preliminarily measured by a chromaticity adjuster and those coefficients are multiplied to the data of the other one or two colors constructing the same one pixel in order to correct so that each of the three primary colors of the color light emission is set to a chromaticity point in a correction range as will be explained hereinlater. Those coefficients are stored into the chromaticity correction data memory 21. Specifically speaking, since green (G) having a variation is corrected by red (R) and/or blue (B) constructing the same one pixel, the chromaticity correction coefficients are formed so that the primary colors are set to the chromaticity points in the correction range as will be explained hereinlater.

The inputted light emission data is supplied to the latch 13R for RDATA, latch 13G for GDATA, and latch 13B for BDATA and latched as R, G, and B data every pixel. At this time, the light emission data is inputted as serial data. The light emission data of red is latched into the latch 13R for RDATA at a timing when the light emission data of red in the light emission data is inputted. The light emission data of green is latched into the latch 13G for GDATA at a timing when the light emission data of green is inputted. The light emission data of blue is latched into the latch 13B for BDATA at a timing when the light emission data of blue is inputted. That is, the serial/parallel conversion is performed in the latch 13R for RDATA, latch 13G for GDATA, and latch 13B for BDATA, respectively.

In the arithmetic operation processing unit 14, the latched R, G, and B data and the chromaticity correction coefficients written in the chromaticity correction coefficient register 16 are arithmetically operated, thereby forming correction light emission data. The formed correction light emission data is supplied to the data memory 15. The supplied correction light emission data is stored into the data memory 15. The data memory 15 is constructed by a memory of a frame unit and the writing and reading operations of the supplied correction light emission data are controlled by the MPU 17. After all of the correction light emission data to be handled by an LED display 19 was received, the stored correction light emission data is supplied to a constant current driver 18.

The MPU 17 supplies a control signal to a luminance correction data memory 20 in which luminance correction data of the LED display 19 has been stored. The luminance correction data is supplied from the luminance correction data memory 20 to the constant current driver 18 in accordance with the supplied control signal. The luminance correction data is formed by previously measuring the characteristics of the three primary colors by the luminance adjuster and stored into the luminance correction data memory 20 in order to adjust the variation in luminous intensity of each pixel of the LED display 19 by a driving current.

The correction light emission data from the data memory 15 and the luminance correction data from the luminance correction data memory 20 are supplied to the constant current driver 18. In this instance, the current of the amount according to the luminance correction data is supplied to the LED display 19 for only the time corresponding to the correction light emission data. That is, the constant current driver 18 drives the LED display 19 by a PWM (pulse width modulation) method.

In this manner, the LED display 19 which emitted the light can reproduce a uniform image in which both the luminous intensity (luminance) and the light emission wavelength (chromaticity) are matched. As for the LED display 19, as shown in FIG. 2, one pixel is constructed by the RGB trio and a number of pixels are arranged. As an example of such a display, there is a mosaic display (large video display apparatus) provided on the street, stadium, or the like.

According to the embodiment as mentioned above, first, the variation in light emission wavelength (chromaticity) is corrected and, thereafter, the variation in luminous intensity (luminance) is corrected. The correction of the light emission wavelength will now be described in more detail. In the chromaticity correcting unit 12, the light emission wavelength is corrected every pixel. As a method of correcting the color variation occurring due to the variation in light emission wavelength, a chromaticity converting function is provided every pixel.

For example, even if the same input signals R, G, and B are inputted, since the light emission wavelengths of the pixels differ, the CIE tristimulus values differ. As an example of such a case, CIE tristimulus values when the same input signals R, G, and B are supplied to the pixels 1 and 2 are shown in the following equations (1) and (2).

$$Pixel\ 1: \begin{pmatrix} X \\ Y \\ Z \end{pmatrix} = (Aij) \begin{pmatrix} R \\ G \\ B \end{pmatrix} \tag{1}$$

$$Pixel\ 2: \begin{pmatrix} X \\ Y \\ Z \end{pmatrix} = (Aij) \begin{pmatrix} R \\ G \\ B \end{pmatrix} \tag{2}$$

where, $A_{ij}$: color conversion coefficient of the pixel 1

$A'_{ij}$: color conversion coefficient of the pixel 2

X, Y, Z: CIE tristimulus values of the pixel 1

X', Y', Z': CIE tristimulus values of the pixel 2

To make an explanation easy, explanation will now be made hereinbelow with respect to only the pixel 1. Chromaticities of the LEDs of R, G, and B of the pixel 1 are shown below.

| | x | y |
|---|---|---|
| R | 0.6882 | 0.3044 |
| G | 0.1988 | 0.6964 |
| B | 0.1319 | 0.0808 |

It is now assumed that luminance ratios of the LEDs of R, G, and B are set to

LR:LG:LB=0.1986:0.7073:0.0941

The chromaticities of three primary colors which the pixel 1 has to inherently express and the chromaticities of reference white set so as to be obtained by mixing the three primary colors are shown below.

| | x | y |
|---|---|---|
| R | 0.647 | 0.3267 |
| G | 0.2077 | 0.648 |
| B | 0.1394 | 0.0873 |
| W | 0.2866 | 0.3316 |

When the input signals R, G, and B are supplied to the pixel 1, the CIE tristimulus values X, Y, and Z of the pixel 1 are as shown by the following equation (3).

$$\begin{pmatrix} X \\ Y \\ Z \end{pmatrix} = \begin{bmatrix} 0.4540 & 0.2015 & 0.1522 \\ 0.2008 & 0.7059 & 0.1522 \\ 0.0049 & 0.1062 & 0.9084 \end{bmatrix} \begin{pmatrix} R \\ G \\ B \end{pmatrix} = (Aij) \begin{pmatrix} R \\ G \\ B \end{pmatrix} \tag{3}$$

CIE tristimulus values $X_0$, $Y_0$, and $Z_0$ when the same input signals R, G, and B are supplied for the chromaticities of three primary colors which the pixel 1 has to inherently express and reference white are shown by the following equation (4).

$$\begin{pmatrix} X_0 \\ Y_0 \\ Z_0 \end{pmatrix} = \begin{bmatrix} 0.4789 & 0.2073 & 0.1781 \\ 0.2418 & 0.6466 & 0.1115 \\ 0.0195 & 0.1440 & 0.9879 \end{bmatrix} \begin{pmatrix} R \\ G \\ B \end{pmatrix} = (Bij) \begin{pmatrix} R \\ G \\ B \end{pmatrix} \tag{4}$$

To obtain the following equation $$\begin{pmatrix} X \\ Y \\ Z \end{pmatrix} = \begin{pmatrix} X_0 \\ Y_0 \\ Z_0 \end{pmatrix}$$

in the embodiment, the input signals R, G, and B supplied to the pixel 1 are converted into signals R', G', and B' by multiplying the input signals R, G, and B by a chromaticity correction coefficient $C_{ij}$ in accordance with the following equation (5).

$$\begin{pmatrix} R' \\ G' \\ B' \end{pmatrix} = (Cij) \begin{pmatrix} R \\ G \\ B \end{pmatrix} \tag{5}$$

By substituting the converted signals R', G', and B' into the equation (3), the following equation (6) is obtained.

$$\begin{pmatrix} X_0 \\ Y_0 \\ Z_0 \end{pmatrix} = (Aij)(Cij) \begin{pmatrix} R \\ G \\ B \end{pmatrix} \tag{6}$$

Therefore, $(B_{ij})=(A_{ij})(C_{ij})$ is obtained from the equations (4) and (6). Thus, the chromaticity correction coefficient $(C_{ij})=(A_{ij})^{-1}(B_{ij})$ of the signal is obtained. In this example, the following equation is obtained.

$$(Cij) = \begin{bmatrix} 1.0300 & 0.0404 & 0.0247 \\ 0.0482 & 0.8975 & 0.0075 \\ 0.0103 & 0.0543 & 1.0865 \end{bmatrix}$$

By executing the above operations with respect to all of the pixels of the RGB trio, the obtained chromaticity correction coefficient $C_{ij}$ is stored into the chromaticity correction data memory 21. As mentioned above, according to the mosaic display such that to one color in the trio of the pixels, the chromaticity correction to add the other one or two colors in this trio has been performed by using the chromaticity correction coefficient $C_{ij}$, the uniform picture quality is obtained.

A variation in LED will now be described by using a CIE chromaticity diagram shown in FIG. 4. The variation in light emission chromaticity of the LED, NTSC reproduction, light emission chromaticity points after completion of the correction of a CRT fluorescent material, and the like are shown on the CIE chromaticity diagram shown in FIG. 4. The CRT chromaticity points are light emission chromaticity points of the three primary colors after completion of the correction of a CRT made of a fluorescent material of P-22. The NTSC reproduction indicates the light emission chromaticity points of the three primary colors determined by the NTSC system. Color variation ranges Ar1, Ag1, and Ab1 shown by hatched regions are variation ranges of the three primary colors due to the light emission wavelength when the LEDs are manufactured. Correction ranges Ar2, Ag2, and Ab2 shown by cross marks "+" are ranges after the variation in the input signals R, G, and B was corrected and are color discriminating ranges of MacAdam in which it is difficult to discriminate the colors of the three primary colors.

Tangential lines La1, La2, and La3 connecting an outer edge of the color variation range Ar1 of red and an outer edge of the color variation range Ag1 of green are displayed on the CIE chromaticity diagram. Tangential lines Lb1, Lb2, and Lb3 connecting an outer edge of the color variation range Ag1 of green and an outer edge of the color variation range Ab1 of blue are displayed on the CIE chromaticity diagram. Tangential lines Lc1, Lc2, and Lc3 connecting an outer edge of the color variation range Ab1 of blue and an outer edge of the color variation range Ar1 of red are displayed on the CIE chromaticity diagram. Pr, Pg, and Pb denote intersecting points which are obtained so as to minimize angles which are formed on the side which is directed toward the color variation ranges Ar1, Arg1, and Ab1 of the respective colors. That is, the intersecting points Pr, Pg, and Pb are formed by the tangential lines La1, Lb1, and Lc1 serving as innermost sides of the tangential lines. The intersecting points Pr, Pg, and Pb are included in the correction ranges Ar2, Ag2, and Ab2.

In the embodiment, by correcting the variation in each of the three primary colors, the LEDs are allowed to emit the light as if the light emission wavelengths of the color variation ranges Ar1, Ag1, and Ab1 were equal to the light emission wavelengths at the positions of the intersecting points Pr, Pg, and Pb, respectively. A color gamut shown in a triangle specified by vertexes Pr, Pg, and Pb on the chromaticity diagram is included in a color gamut shown in a triangle in which one arbitrary light emission chromaticity point selected in each region of the color variation ranges Ar1, Arg1, and Ab1 of three primary colors is set to a vertex. Therefore, assuming that Pr, Pg, and Pb are set to chromaticity points to be corrected, so long as the LEDs corresponding to three primary colors lie within each range having each color variation of the Ar1, Ag1, and Ab1, it is possible to adjust to the chromaticity shown by Pr, Pg, and Pb, even by using any of the LEDs. In this instance, by correcting the variation in each of the three primary colors, the LEDs can be allowed to emit the light as if the light emission wavelengths of the color variation ranges Ar1, Ag1, and Ab1 were equal to the light emission wavelengths in the correction ranges Ar2, Ag2, and Ab2, respectively. As mentioned above, the correction ranges Ar2, Ag2, and Ab2 are the ranges where it is difficult to discriminate the colors. For example, the color is seen as if light emission wavelength included in the correction range Ag2 of green was equal to the light emission wavelength at the position of the intersecting point Pg. That is, by correcting the light emission wavelengths (color variation ranges Ar1, Ag1, Ab1) of the LED with a variation as if the LED emitted the light in the ranges (correction ranges) Ar2, Ag2, and Ab2 where it is difficult to discriminate the colors, the display device is allowed to be seen as if the LEDs emitted the lights of the light emission wavelengths at the positions of the intersecting points Pr, Pg, and Pb, thereby suppressing the influence by the variation of the light emission wavelength of the LED.

Specifically speaking, the red LED constructing the same one pixel and/or the blue LED is corrected by the chromaticity correction coefficient $C_{ij}$ in a manner such that the green LED in the RGB trio is included in a range from the color variation range Ag1 to the correction range Ag2 and is allowed to emit the light.

Figure 4:
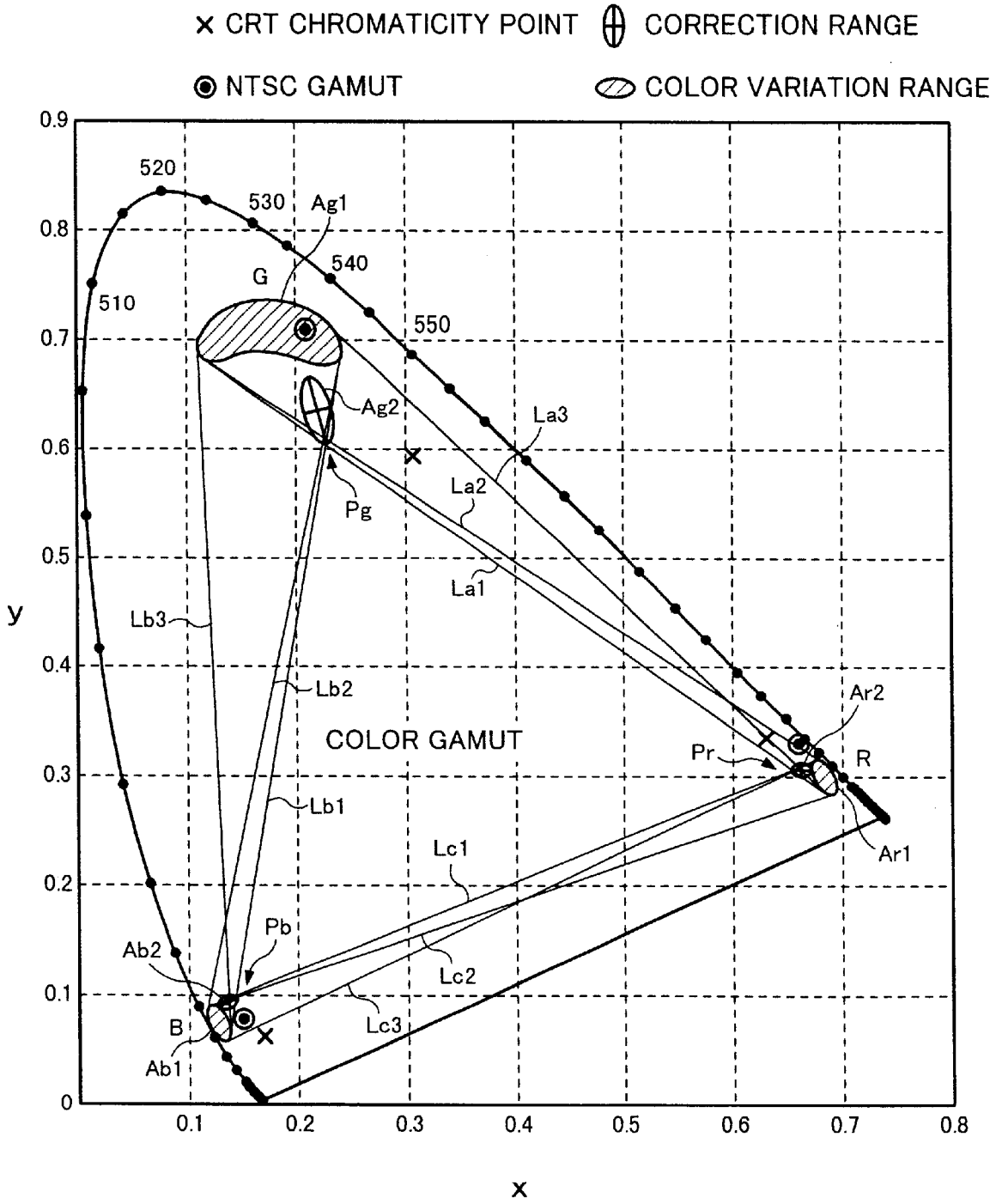
FIG. 4 is an example of a chromaticity diagram for explaining colors according to the invention.

The color gamut after the correction is a range in a triangle formed by the intersecting points Pr, Pg, and Pb as shown in FIG. 4. Although the color gamut is narrowed by perfectly setting the light emitting points to a single point, the color gamut can be widened by extending It In the directions of the color discriminating range (correction ranges Ar2, Ag2, Ab2) of MacAdam.

Although the correction is made to the three primary colors of red, green, and blue in the embodiment, as shown in FIG. 4. since the green variation range Ag1 is largest, even if the chromaticity correction is performed to only green, a similar effect can be obtained.

Although the LED has been used as an example of the emitter in the embodiment, the invention can be also similarly applied to the case using a discharge tube, CRT, liquid crystal, or the like.

Although the correcting circuit has been used every pixel constructed by the RGB trio in the embodiment, it is also possible to divide the screen of the mosaic display into a plurality of units and use the correcting circuit for every unit. For example, by arranging the LEDs having a variation In characteristics onto the unit at random, the uniformity in the unit can be assured when It Is seen from a distance. However, since differences of the light emission wavelengths (chromaticities) among the units occur, by having the correcting circuit every unit, the uniformity of the light emission wavelengths of the whole screen can be improved and differences of the expression colors among the units can be also corrected.

When the display device of three primary colors is driven, to the data of one color in the trio, by adding the data obtained by multiplying the data of the other one or two colors in the trio by the pre-obtained chromaticity correction coefficient, the display devices of the different light emission wavelengths can be seen as if they emitted the light of the same light emission wavelength. Therefore, the rank management of the light emission wavelengths of the display devices is unnecessary. The excessive costs for the improvement of the productivity of products, the service performance, the rank management of product stocks, and the like can be reduced and the products of the uniform image display quality can be stably manufactured.

The present invention is not limited to the foregoing embodiments but many modifications and variations are possible within the spirit and scope of the appended claims of the invention.

What is claimed:

1. A display apparatus for displaying an input signal, the apparatus comprising:

a set of trios each including emitters of three primary colors on the basis of the input signal; and chromaticity correcting means for adding to data of one color in said trio data obtained by multiplying data of the other one or two colors in said trio by a pre-obtained chromaticity correction coefficient when each of said emitters of the three primary colors is driven by the input signal.

2. The apparatus according to claim 1, further comprising means for driving said emitters of the three primary colors on the basis of pre-obtained luminance correction data to correct a luminance of said emitters.

3. The apparatus according to claim 1, wherein said chromaticity correcting means comprises:

a memory for storing said chromaticity correction coefficient; and arithmetic operating means for performing an arithmetic operation on said input signal and said chromaticity correction coefficient, whereby said trio corresponding to said input signal is driven in accordance with a result of the arithmetic operation of said arithmetic operating means.

4. The apparatus according to claim 1, wherein said chromaticity correcting means comprises:

means for setting a first range formed by a variation in a light emission color of a first color of said emitters of the three primary colors;

means for setting a second range formed by a variation in a light emission color of a second color of said emitters of the three primary colors; and means for setting a third range formed by a variation in a light emission color of a third color of said emitters of the three primary colors, wherein said chromaticity correcting means corrects said first color to a chromaticity represented by an intersecting point obtained so as to minimize an angle formed on a side directing toward said first range among angles which are formed by intersecting a first tangential line connecting an outer edge of said first range and an outer edge of said second range and a second tangential line connecting the outer edge of said first range and an outer edge of said third range as displayed on a chromaticity diagram.

5. The apparatus according to claim 4, wherein said chromaticity correcting means corrects said second color to a chromaticity represented by an intersecting point obtained so as to minimize an angle formed on the side directing toward said second range among angles formed by intersecting said first tangential line and a third tangential line connecting the outer edge of said second range and the outer edge of said third range, and said chromatically correcting means corrects said third color to a chromaticity represented by an intersecting point obtained so as to minimize an angle formed on the side directing toward said third range among angles formed by intersecting said second tangential line and said third tangential line.

6. The apparatus according to claim 1, wherein said chromaticity correcting means comprises:

means for setting a first range formed by a variation in a light emission color of a first color of said emitters of the three primary colors;

means for setting a second range formed by a variation in a light emission color of a second color of said emitters of the three primary colors;

means for setting a third range formed by a variation in a light emission color of a third color of said emitters of the three primary colors;

means for obtaining an intersecting point to minimize an angle formed on a side directing toward said first range among angles which are formed by intersecting a first tangential line connecting an outer edge of said first range and an outer edge of said second range and a second tangential line connecting the outer edge of said first range and an outer edge of said third range; and means for setting a forth range existing on a side away from a reference white color which is obtained by synthesizing said three primary colors with a chromaticity shown by said intersecting point.

7. The apparatus according to claim 4 or 6, wherein said three primary colors are red, blue, and green and said first color is green.

8. The apparatus according to claim 6, wherein said fourth range is a color discriminating range of MacAdam.

9. The apparatus according to claim 1, wherein said emitters of the three primary colors are light emitting diodes.

* * * * *